United States Patent [19]

Barclay

[11] Patent Number: 4,776,249

[45] Date of Patent: Oct. 11, 1988

[54] RESHARPENABLE ROTARY SHEARING APPARATUS

[76] Inventor: Randel L. Barclay, 5616 Carpenter Rd., Stockton, Calif. 95205

[21] Appl. No.: 79,170

[22] Filed: Jul. 27, 1987

Related U.S. Application Data

[63] Continuation-in-part of Ser. No. 924,289, Oct. 29, 1986, Pat. No. 4,682,522.

[51] Int. Cl.[4] ..... B26D 1/24; B21K 21/00

[52] U.S. Cl. ..... 83/673; 83/675; 83/500; 83/923; 241/DIG. 31; 76/101 A; 76/112

[58] Field of Search ..... 83/673, 675, 500, 838; 76/101 A, 112; 241/DIG. 31

[56] References Cited

U.S. PATENT DOCUMENTS

| | | | |
|---|---|---|---|
| 2,666,485 | 1/1954 | Antosh | 164/70 |
| 3,447,578 | 6/1969 | Mitten | 144/218 |
| 3,931,935 | 1/1976 | Holman | 241/80 |
| 3,991,944 | 11/1976 | Baikoff | 241/36 |
| 4,151,869 | 5/1979 | Halloran et al. | 144/218 |
| 4,241,882 | 12/1980 | Baikoff | 241/DIG. 31 |
| 4,374,573 | 2/1983 | Rouse et al. | 241/101.7 |
| 4,594,928 | 6/1986 | Thomas et al. | 144/218 |
| 4,607,800 | 8/1986 | Barclay | 241/159 |
| 4,682,522 | 7/1987 | Barclay | 241/DIG. 31 |

FOREIGN PATENT DOCUMENTS

| | | | |
|---|---|---|---|
| 3413614 | 10/1985 | Fed. Rep. of Germany . | |
| 377943 | 1/1931 | United Kingdom | 83/838 |

*Primary Examiner*—Donald R. Schran
*Attorney, Agent, or Firm*—Thomas Schneck

[57] ABSTRACT

A shearing wheel, and a method of assembling the same, having an annular carrier and having a plurality of arcuate segments side mounted to a segment receiving surface of the annular carrier. The arcuate segments are laid in an end-to-end fashion to form an annulus with the outside diameter of the annulus having a radial extent greater than the radial extent of the annular carrier. A support shoulder extends axially outward from the annular carrier to contact the surface of the arcuate segments defined by the inside diameter of the annulus. The arcuate segments may be removed and sharpened, whereafter shims are inserted between the arcuate segments and the annular carrier to properly space the segments from an adjacent shearing wheel. Optionally, arcuate segments may be mounted to both side faces of the annular carrier.

12 Claims, 5 Drawing Sheets

10
12
14
16
18
20
22
24
26
28
30
32
33
34
36
38

RESHARPENABLE ROTARY SHEARING APPARATUS

DESCRIPTION

CROSS REFERENCE TO RELATED APPLICATION

This is a continuation-in-part of application Ser. No. 924,289, filed Oct. 29, 1986, now U.S. Pat. No. 4,682,522.

TECHNICAL FIELD

The invention relates generally to conversion of solid waste into small pieces by shearing and relates particularly to cutting wheels for shearing.

BACKGROUND ART

The problem of disposal of bulky solid waste material is receiving increasing attention. Preferably, waste material, such as old appliances and tires, is reduced in size in an early stage of waste disposal. Among the reasons for size reduction are volume densification and the requirements of subsequent processing, such as burial or combustion.

For example, sometimes discarded tires are segmented prior to transportation to a dump site or to a processing plant for recycling tires into fuel. The dimensions of a tire make it difficult to stack tires in a low volume. In transporting tires, motor trucks will often carry only one-half a full load by weight. Since a motor truck operated at less than a full load costs very nearly as much as a truck which is at its load capacity, the cost effectiveness of transporting tires may be increased by volume densification prior to shipment.

Apparatus for shredding rubber tires and other waste materials are known. U.S. Pat. Nos. 4,607,800 to Barclay, 4,374,573 to Rouse et al. and 3,931,935 to Holman disclose machines for size reduction of waste. Such machines include counter-rotating shearing wheels which overlap for material shearing cooperative engagement. Because of the difficulty in cutting solid waste, extremely hard materials must be employed in constructing shearing wheels. Generally, a chrome alloy tool steel is used. Such materials are very expensive and, given the low profit margin of waste recycling, are often cost prohibitive.

German Pat. No. 3,413,614 discloses a machine for cutting up tires which reduces the cost of manufacturing cutting wheels. Each wheel has a core made of tough high tensile steel with the blade edges being formed from a layer of wear-resistant metal which is deposited onto the steel core by welding. However, the German patent emphasizes a cutting action rather than the shearing action of the above-identified U.S. patents. A cutting action is only sufficient in a limited number of waste reduction applications. Additionally, the cutting wheels require complete replacement upon wear of the blades. The industrial goal for durability of cutting wheels is 1000 hours. Typically, however, such wheels must be replaced every four to six work weeks at a cost of thousands of dollars.

The patents to Rouse et al. and Holman, in comparison, teach overlapping shingle-type strips about the circumferential periphery of a cutter wheel. The strips are made of chrome alloy tool steel, while the core of the cutter wheel is constructed of steel. After the strips have worn to a point at which the spacing between adjacent wheels has increased to 0.03 inches, the strips are discarded and replaced with new shingle-type strips. Thus, the strips permit continuing use of a cutter wheel with only the strips needing regular replacement. However, because the shingle-type strips are in overlapping relation to each other so that they must be removed individually, the down time of a waste shearing machine during strip replacement is lengthy. Moreover, worn strips cannot be sharpened for reuse.

It is an object of the present invention to provide a shearing wheel which substantially reduces the down-time required in restoring a worn shearing wheel to a proper operating condition. It is a further object to provide such a shearing wheel which permits resharpening after the hardened shearing material of the wheel has worn.

DISCLOSURE OF THE INVENTION

The above objects have been met by a shearing wheel which departs from the standard of having shearing material at the circumferential periphery of the wheel. The shearing wheel includes an annular carrier, or core. A plurality of arcuate segments of hardened metal are mounted to the radially outward portion of a side face of the carrier so that a substantially less amount of the metal is required than would be necessary if the entire wheel were to be constructed of shearing material. The arcuate segments are disposed in an end-to-end fashion to define an annulus having an outer radius that extends beyond the circumferential periphery of the carrier. To facilitate removal within the confines of a waste reduction machine, the segments should be at least three in number, but to ensure against a lengthy down-time during removal there preferably are not more than eight segments of 45° each.

Optionally, the side face of the carrier includes a support shoulder extending axially outwardly for contact with the inner surfaces of the arcuate segments. The support shoulder should have an axial extent that is less than the width of the segments so that the segments will have an overhang portion beyond the support shoulder.

An advantage of the present invention is that it permits reuse of worn arcuate segments. The hardened shearing material is side mounted to the annular carrier, rather than surface mounted. That is, the segments are mounted to the side face of the carrier by bolts which pass through the side face for fastening to internally threaded bores in the segments. After the segments are worn, the segments may be removed for abrasive grinding. The wear takes place at the planar ends of the arcuate segments opposite the connection to the carrier. Worn segments may undergo abrasive grinding and then be replaced upon the carrier. Shims disposed between the segments and the carrier properly position the shearing surface relative to a shearing surface of an adjacent wheel. The side mounting of the arcuate segments, unlike a surface mounting procedure, permits use of shims to properly space adjacent shearing wheels. Optionally, carriers may include means for repositioning a shearing wheel along the shaft upon which the shearing wheel is mounted, thereby making the use of shims unnecessary. The shims, however, are the preferred method.

A second advantage, as noted above, is that the present invention reduces the down-time in replacing worn material, as a plurality of sawteeth are on each segment. A third advantage is that the outer surface of the annulus of arcuate segments may have a sawtooth configuration or may be circular.

BEST MODE FOR CARRYING OUT THE INVENTION

Figures 1, 1A:
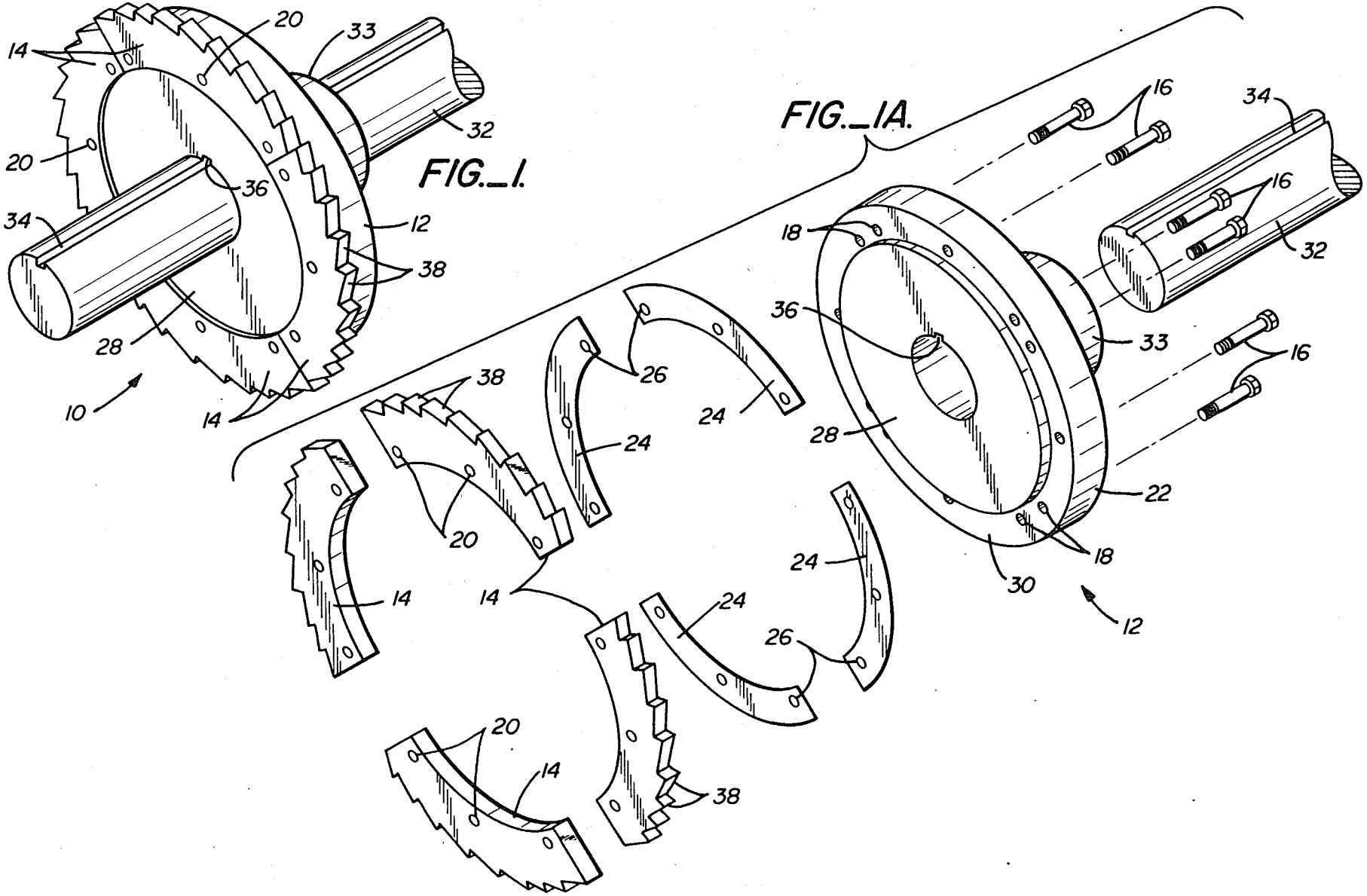
FIG. 1 is a perspective view of a shearing wheel in accord with the present invention.
FIG. 1A is an exploded view of the shearing wheel of FIG. 1.

With reference to FIGS. 1 and 1A, a shearing wheel 10 includes an annular carrier 12 and a plurality of arcuate shearing segments 14. The shearing segments 14 are mounted to the carrier 12 by a plurality of bolts 16 which penetrate bores 18 of the carrier for securement to aligned internally threaded holes 20 in the shearing segments. Thus, the shearing members 14 are side mounted to the carrier, rather than surface mounted to the circumferential periphery 22 of the carrier 12.

The shearing segments 14 are made of chrome alloy tool steel or similar material, while the carrier 12 is made of steel. These materials are not critical but the shearing segments should be constructed from a hardened, wear-resistant material for cutting into discarded tires, appliances and the like.

The shearing segments 14 may be spaced apart from the carrier 12 by shims 24. The sgnificance of the shims 24 will be pointed out below. Each shim 24 includes holes 26 for passage of bolts 16. The shims 24 and the arcuate shearing segments 14 have radially inward surfaces which contact a support shoulder 28 of the carrier. The support shoulder 28 enhances the mechanical strength of the shearing wheel 10 during operation. The shearing segments preferably extend axially outward beyond the support shoulder 28, relative to mounting side face 30 of the carrier. Moreover, the shearing segments extend radially outward beyond the circumferential periphery 22 of the carrier.

The shearing wheel 10 is mounted to a shaft 32. A hub 33 at the end of the carrier 12 opposite the mounting side face 30 includes a pair of bolts, not shown, which extend perpendicularly to the shaft 32 to secure the shearing wheel 10 to the shaft. The shearing wheel is positioned by a key 34 on the circumference of the shaft 32 and by a key slot 36 at the inside diameter of the carrier 12.

The shearing segments 14 are laid in an end-to-end fashion to define an annulus. In a preferred embodiment the outside diameter of the annulus of shearing segments is 23.25 inches. The shearing segments 14 of FIGS. 1 and 1A include sawtooth shaped teeth 38 which are 0.5 inches in radial height. The shearing segments may have a height from the inside diameter to the outside diameter of the annulus that is in the range of 1.5 inches and 6 inches. The shearing members have an axial width of approximately one inch, but the width is not critical. The shaft 32 has a diameter of approximately 5.5 inches.

Figure 2A:
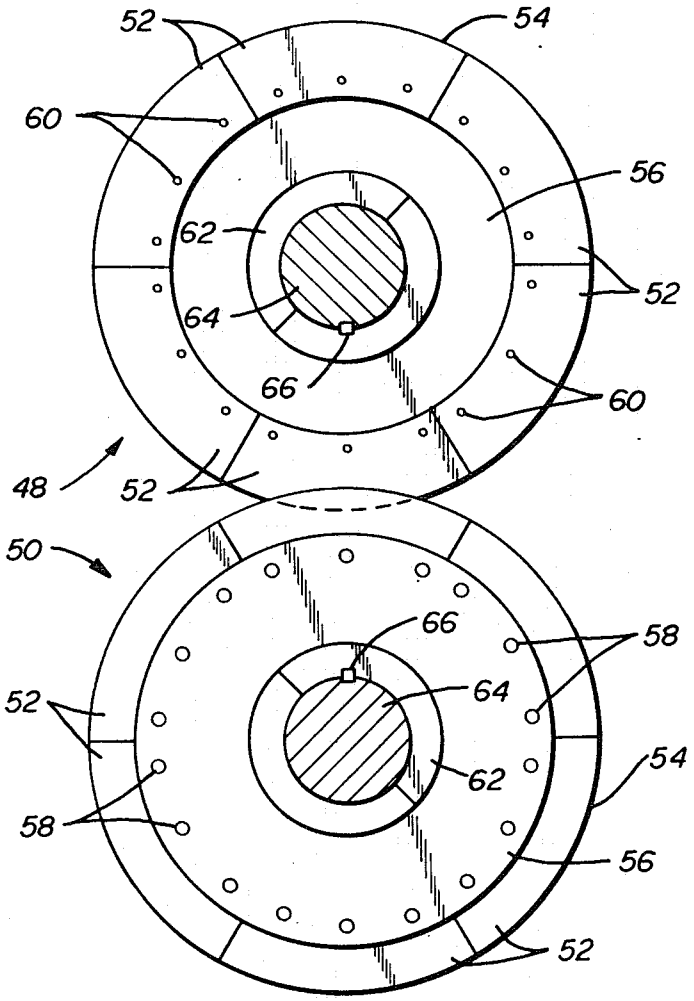
FIG. 2A is a side view of a second embodiment of the shearing wheels of FIG. 2.
Figure 2:
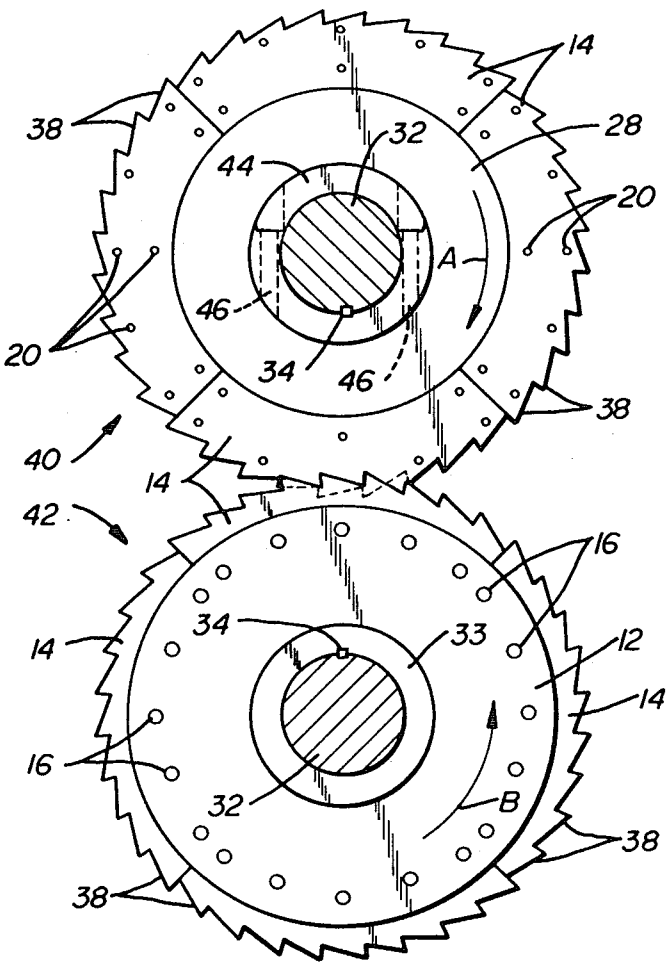
FIG. 2 is a side view of a pair of shearing wheels of FIG. 1A in material shearing cooperative engagement.
Figure 3:
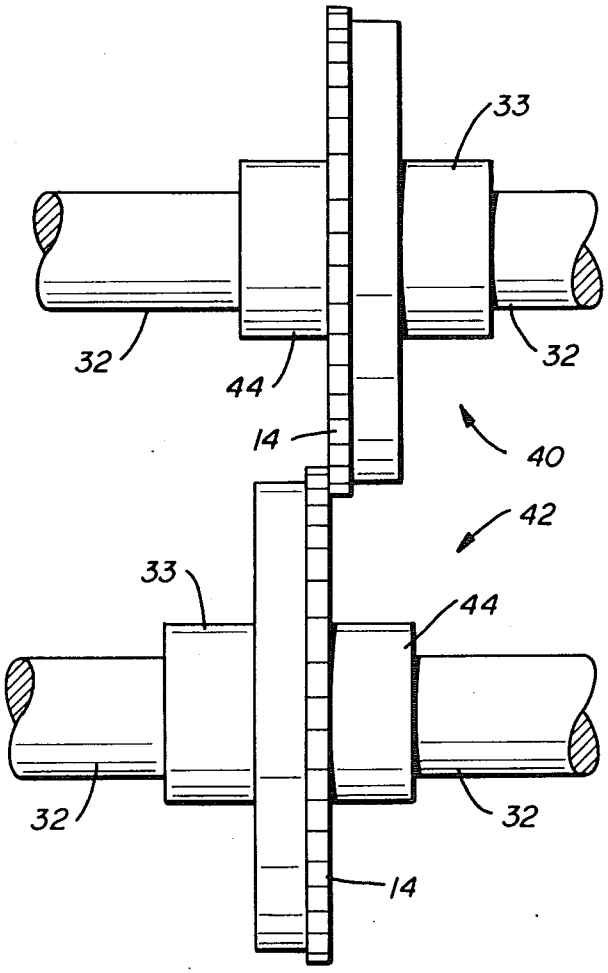
FIG. 3 is a rear view of the shearing wheels of FIG. 2.

Referring now to FIGS. 2 and 3, shearing operation requires at least two counter-rotating shearing wheels 40 and 42. The shearing wheels 40 and 42 are each identical to that shown in FIGS. 1 and 1A other than the inclusion of a second hub 44 opposite the first hub 33. A pair of parallelly disposed shafts 32 are driven to rotate the shearing wheels 40 and 42 in the directions of Arrows A and B. Shafts 32 may be rotated from between zero and twenty revolutions per minute. It has been found that rotation at 9.5 RPM is best for shearing segment 14 life preservation. The shearing wheels 40 and 42 are secured to the shafts 32 by bolts 46 and positioned by keys 34.

Figure 3A:
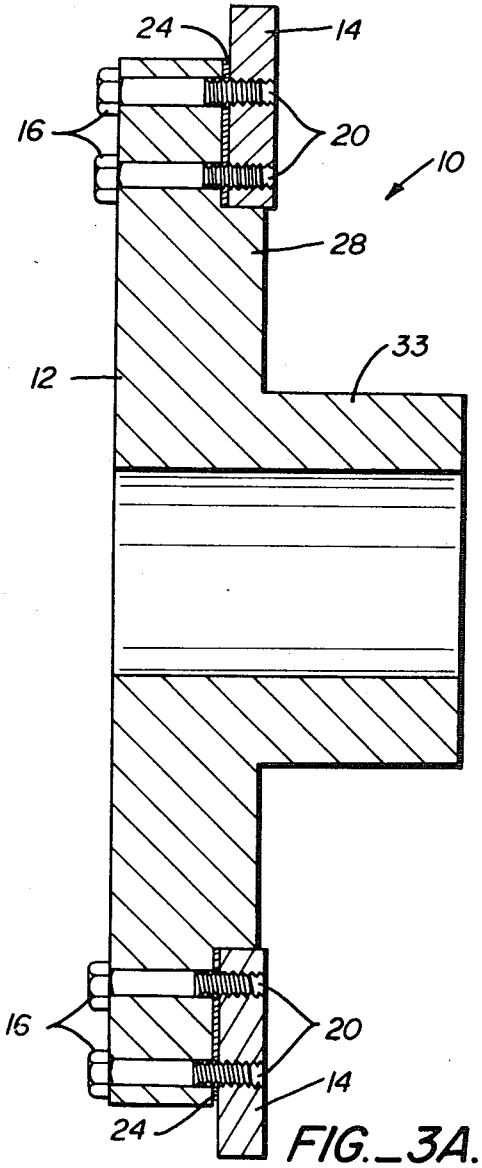
FIG. 3A is a rear sectional view of a shearing wheel of FIG. 1.

Adjacent shearing wheels 40 and 42 overlap by as much as two inches. The axial clearance between adjacent shearing wheels is critical since contact between the surfaces of the wheels will cause premature wear, and excessive clearance will cause the wheels to tear waste material rather than causing a more efficient shearing action. Preferably, the axial clearance should be 0.002 inches, but should not exceed 0.03 inches. The shearing segments 14 have planar axially outward surfaces which are the shearing surfaces. The shearing segments are machined to provide sharp cutting edges. However, the arduous operation of shearing waste material will dull the cutting edges and will wear into the shearing segments 14. When wear becomes excessive, the shearing segments 14 may be replaced by removal of bolts 16 from the internally threaded holes 20. FIG. 3A is a sectional view of the shearing wheel 10 of FIG. 1. Shearing segments 14 are secured to the carrier 12 by bolts 16 that are fastened to internally threaded bores 20. Shims 24 may be employed to properly position the shearing edge of the wheels 10 relative to an adjacent wheel. FIG. 3A illustrates the hub as being integral with the carrier 12, but it is to be understood that this is not critical. The hub may be separately formed and then attached to the carrier by welding or other such attachment means known in the art.

The shearing segments 14 of FIGS. 2 and 3 include sawtooth shaped teeth 38. The teeth 38 act to positively feed waste material into the shear point of adjacent wheels 40 and 42. Moreover, the teeth 38 operate to cut into the waste material much like a saw blade, thereby providing both a sawing and a shearing action. The shearing wheels 48 and 50 of FIG. 2A, in comparison, do not include sawtooth-shaped teeth. Shearing segments 52 are laid in an end-to-end fashion to form an annulus, but the outside diameter 54 of the annulus is smooth, rather than sawtoothed. Thus, the size reduction of waste material is accomplished by shearing action only. The wheels 48 and 50 may be utilized in waste reduction machines having separate means for positively feeding waste material to the wheels.

The shearing segments 52 are mounted to an annular carrier 56 by bolts 58 which penetrate the carrier 56 and are received by internally theaded bores 60. FIG. 2A best illustrates a split hub 62 which may be employed in seating the shearing wheels 48 and 50 on shafts 64.

Optionally, the shearing wheels 48 and 50 are of the tapered locking type which will permit incremental repositioning of the wheels along the shafts 64. Keys 66 lock the shearing wheels 48 and 50 relative to the shafts 64.

Figure 4:
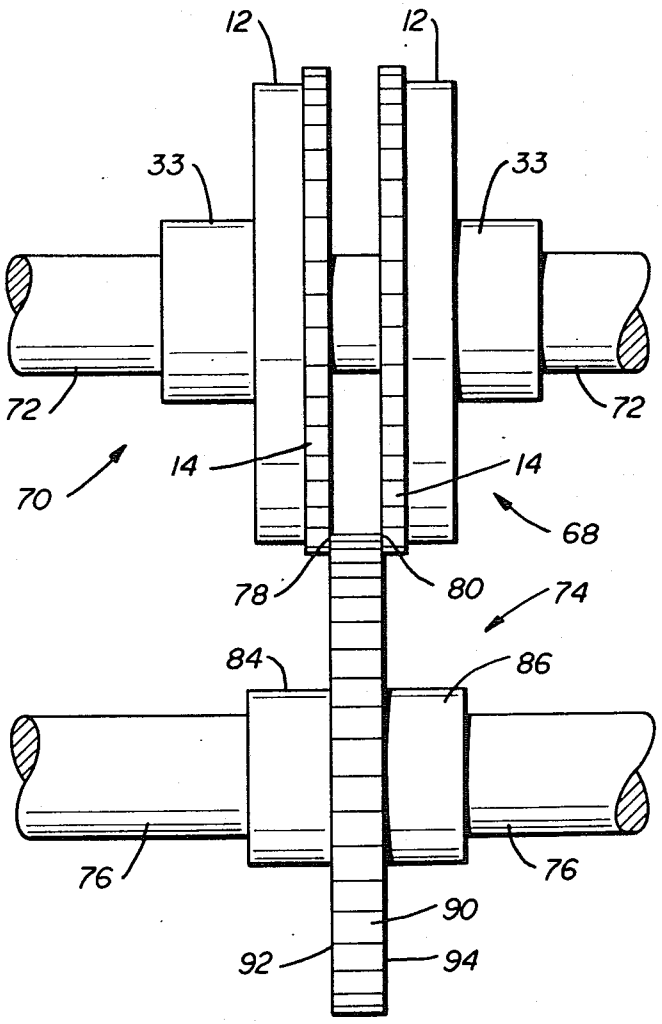
FIG. 4 is a rear view of three shearing wheels in accord with FIG. 1 in material shearing cooperative engagement.

FIG. 4 shows the shearing wheels of a waste reduction apparatus having two wheels 68 and 70 seated upon a first shaft 72 and having a third wheel 74 seated on a second shaft 76. The first and second shaft 72 and 76 are counter-rotationally driven to provide a pair of pinch points 78 and 80. Thus, if an upright tire, for example, is inserted into the pinch points 78 and 80, the rotary wheels 68, 70 and 74 will make a pair of cuts about the circumferential periphery of the tire. A machine for segmenting scrap tires is described in U.S. Pat. No. 4,682,522 to Barclay.

Figure 4A:
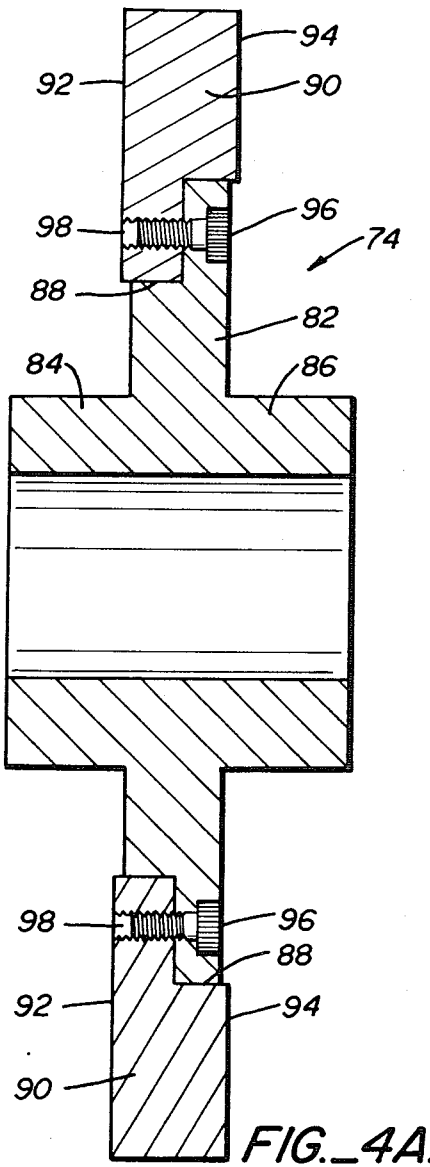
FIG. 4A is a rear sectional view of the lower shearing wheel of FIG. 4.

The upper shearing wheels 68 and 70 are identical to the shearing wheel illustrated in FIG. 1, each having a hub 33, an annular carrier 12 and a plurality of arcuate shearing segments 14. Referring now to FIGS. 4 and 4A, the lower shearing wheel 74 includes a carrier 82 having a pair of hubs 84 and 86 and having a support shoulder 88. A plurality of arcuate shearing segments 90 each include a cross-sectional L-shaped cut to receive the radially outward portion of the carrier 82. In contrast to the previously described shearing segments, both planar side faces 92 and 94 act as shearing surfaces. Bolts 96 are countersunk into the carrier 82 and are received by internally threaded bores 98 in the shearing segments.

Figure 5:
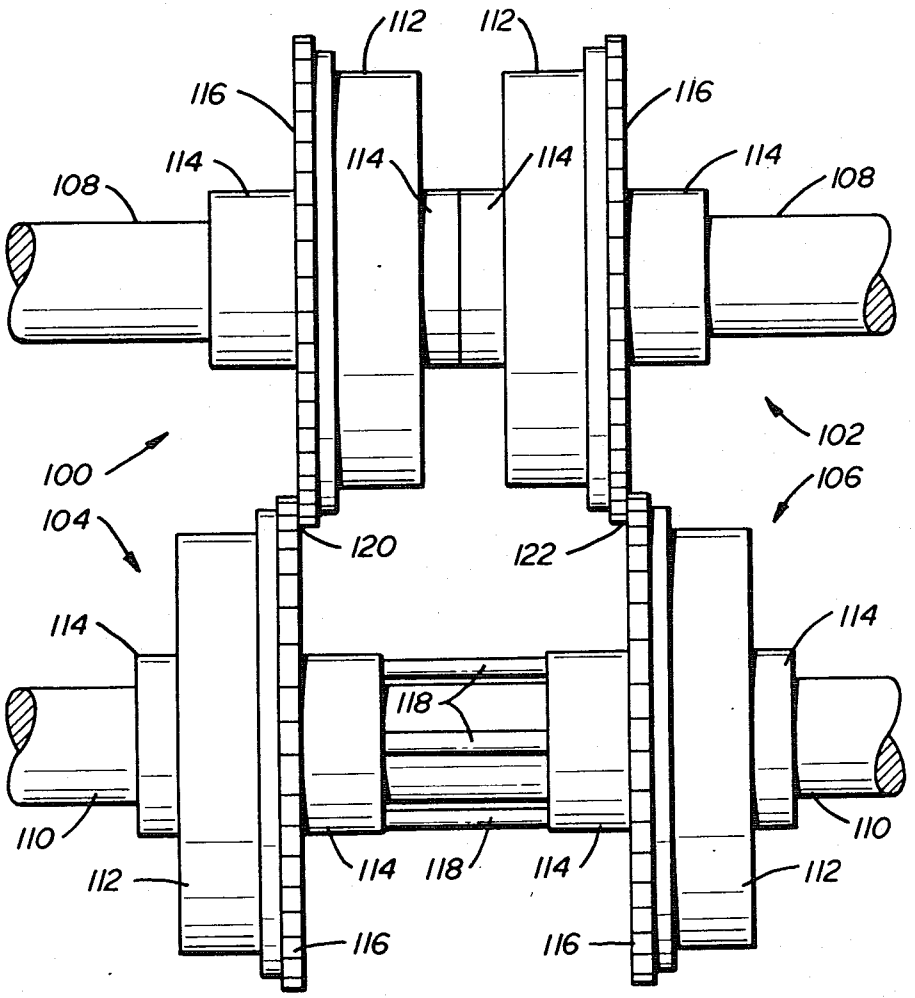

It has been discovered that the area required to store scrap tires may be reduced by 50 percent if the tires are fed upright into the shearer of FIG. 4 to produce three annular segments, whereafter each annular segment is quartered. The quartering process may be accomplished by feeding each annular segment into the shearer of FIG. 5, which is essentially a pair of shearers as illustrated in FIG. 3. Two upper shearing wheels 100 and 102 are in material shearing cooperative engagement with one of two lower shearing wheels 104 and 106. The shearing wheels are keyed to counter-rotating shafts 108 and 110 and each include a carrier 112, opposed hubs 114 and a plurality of arcuate shearing segments 116. The inner hubs 114 of the upper shearing wheels 100 and 102 are shown in abutting relation but this is not critical. Studs 118 passing into hubs 114 may be tightened, thereby providing a means of maintaining proper clearance between an upper wheel 100 and 102 and an associated lower wheel 104 and 106. Again, clearance should not exceed 0.03 inches. An annular tire segment may be fed into the shearer in a manner that causes an arcuate end portion of the tire segment to be separated at pinch point 120, while the opposed arcuate end portion is separated at pinch point 122. Thus, the annular tire segment is segmented into opposed end portions and a pair of arcuate middle portions.

Figure 6A:
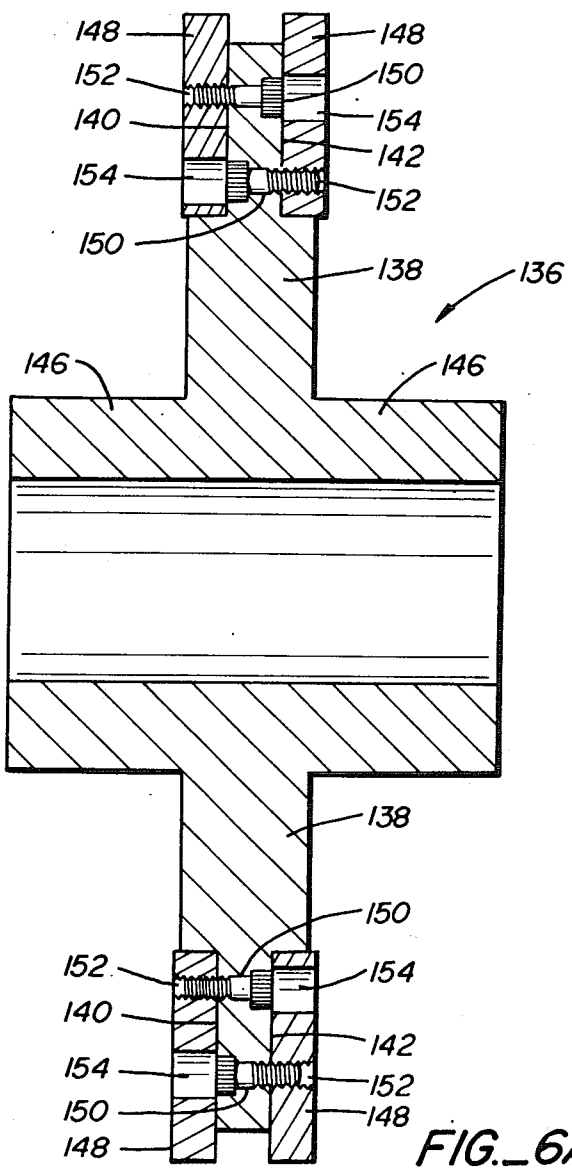
FIG. 6A is a rear sectional view of the upper shearing wheels of FIG. 6.
Figure 6:
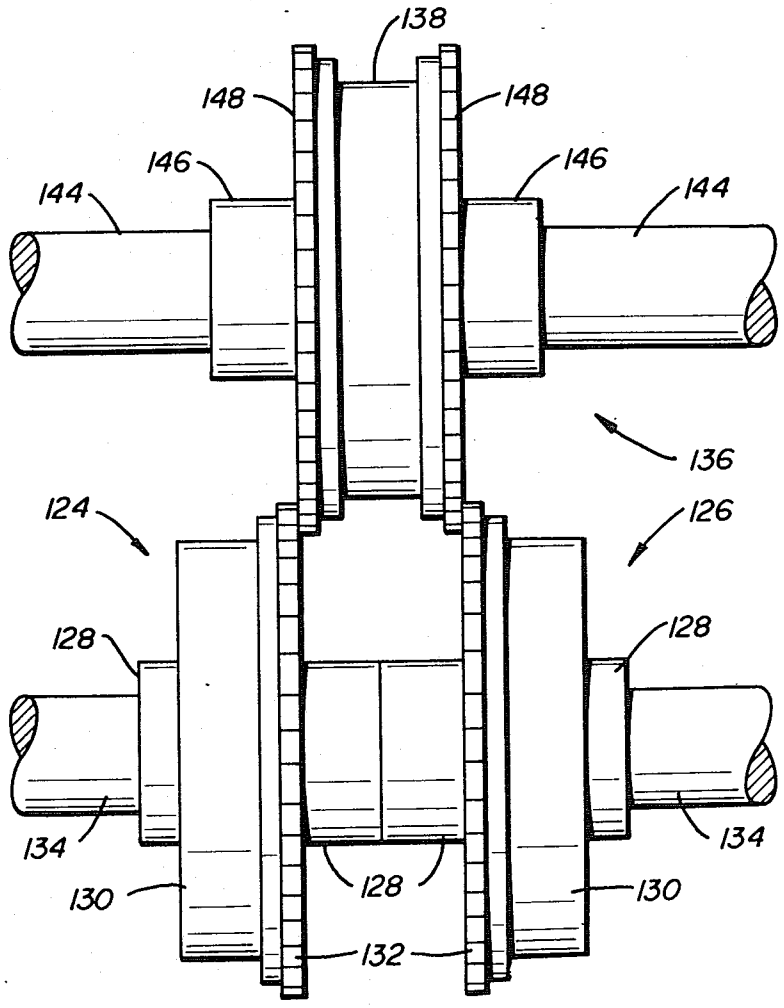
FIGS. 5 and 6 are rear views of shearing wheels in accord with FIG. 1 in material shearing cooperative engagement.

FIG. 6 illustrates another embodiment of a shearing wheel combining to permit quartering of a tire or a tire segment. Lower shearing wheels 124 and 126 are identical to those described above, having opposed hubs 128, a carrier 130 and shearing segments 132. The lower shearing wheels 124 and 126 are keyed to shaft 134.

An upper shearing wheel 136 is shown in FIGS. 6 and 6A. The wheel 136 has a carrier 138 having opposed mounting side faces 140 and 142. The wheel is keyed to a shaft 144 at opposed hubs 146. A plurality of arcuate shearing segments 148 are secured to the mounting side faces 140 and 142 by bolts 150. Each bolt 150 is countersunks into the carrier 138 and is received by an internally threaded bore 152. The bolts 150 have heads with polygonal recesses, not shown. Access holes 154 in each shearing segment 148 provide access to the heads of bolts for securing an opposed shearing segment.

In construction, the shearing wheel 10 of FIG. 1 is provided with an annular carrier 12 which is flame cut from a slab of tool steel. The carrier 12, the support shoulder 28 of the carrier, and the hub 33 may be a single piece of metal or, alternatively, may be separately constructed and then fastened together. The arcuate shearing segments 14 are cut from a planar piece of chrome alloy tool steel. Optionally, the segments 14 may be provided with sawtooth-shaped teeth. In any case, the segments must be machined to include a sharp edge for the shearing of waste material. The bores 20 are drilled and then tapped to provide internal threads. Only after the shearing segments have been machined, drilled and tapped is the metal hardened. Modification of the segments after the hardening process is extremely difficult.

The arcuate shearing segments 14 are then laid in an end-to-end-fashion and side mounted to the carrier 12 to form an annulus. The outside diameter of the annulus should extend beyond the circumferential periphery 22 of the carrier and the shearing segments should overhang the support shoulder 28.

In operation, a pair of counterrotating wheels are overlapped in a material shearing cooperative relation, as shown in FIG. 3. The axially outward planar face of shearing segments 14 initially has a clearance of 0.002 inches from segments 14 of an adjacent wheel 40 and 42. However, in the operation of segmenting scrap tires and other solid waste material the shearing wheels of all waste reduction machines wear relatively quickly. Such wear will occur at the axially outward planar faces and will be most extreme at the outermost edge. After wear has increased the clearance between adjacent shearing segments 14 to a distance of 0.03 inches, the segments must be replaced.

The side mounting of the shearing segments 14 permits reuse of the extremely expensive shearing segments. The segments 14 may be removed and sharpened to once again provide a planar side face and a sharp cutting edge. Subsequently, the segments may be repositioned on the carrier 12. The segments are sharpenend by an abrasive grinding process. Consequently, replacement upon the carrier will not bring the segments of adjacent wheels within a tolerance distance. For this reason the shims 24 in FIG. 1A and 3A are employed. The shims are chosen to bring the resharpened segments 14 once again to the ideal 0.002 clearance. The shims 24 are shown to correspond in number to the shearing segments 14 so that the shims may be chosen for individual segments. However, the spacing may be achieved by a single washer-shaped member.

Alternatively, the clearance between adjacent wheels having resharpened shearing segments 14 may be brought to a tolerable distance by repositioning of the wheels upon the shafts to which the wheels are keyed. Such repositioning is best accomplished by providing the carrier 12 with a tapered lock plate, discussed briefly with reference to FIG. 2A. The shim means of achieving the correct clearance is, however, the preferred method.

The shearing segments 14 should be at least three in number to facilitate removal within the tight confines of a waste reduction machine. Preferably, no more than eight shearing segments, each having an arc of 45°, are mounted to each wheel, since too great a number of segments would require a lengthy down-time of a waste reduction machine during removal of the segments.

While the shearing segments have been illustrated as being mounted to the side face of a carrier by a plurality of bolts, it is to be understood that side mounting may be accomplished by other fastening means which provide a firm but repeatedly removable fit. Although not a preferred embodiment, the carrier and segments may have the same radius, especially if simultaneously cut.

I claim:

1. A resharpenable cutting wheel of prescribed thickness for the shearing of waste material comprising, an annular carrier of a first radius, having first and second faces, with a uniform thickness there between, and an outer circumferential periphery, a plurality of flat arcuate knife segments, each removably mounted in an end-to-end fashion to said first side face of the annular carrier and each having a radially outward shearing edge axially outward of the first side face, said knife segments made of a material at least as hard as hardened steel, the radially outward extent of said arcuate knife segments exceeding the radially outward extent of said annular carrier, and laterally offset from the radially outward extent of the annular carrier, and a plurality of arcuate, flat shim segments disposed between said arcuate knife segments and said first side face of the annular carrier, said shim segments having a thickness which when added to the thickness of said knife segments and said carrier equals a prescribed thickness.

2. The cutting wheel of claim 1 wherein said arcuate knife segments combine to form an annulus, the radially outward surface of said annulus having sawtooth projections.

3. The cutting wheel of claim 1 wherein the number of arcuate knife segments is in the range of three to eight.

4. The cutting wheel of claim 1 wherein said first side face of the annular carrier has an annular support shoulder projecting axially outward relative to said first side face, each arcuate segment having a radially inward edge contacting the circumferential periphery of the support shoulder.

5. The cutting wheel of claim 4 wherein the axial extent of the arcuate knife segments exceeds the axial extent of the support shoulder.

6. The cutting wheel of claim 1 wherein each arcuate knife segment has a plurality of internally threaded bores parallel to the axis of the annular carrier, said arcuate knife segments being mounted to said annular carrier by bolts penetrating said annular carrier for engagement with said internally threaded bores.

7. Resharpenable rotary shearing apparatus of the type having at least two shearing wheels, including a first wheel mounted on a first shaft and a second wheel mounted on a second shaft parallel to the first shaft, the first and second shafts being spaced apart such that the first and second wheels have thicknesses bringing said wheels into a material shearing relation, the improvement comprising, a pair of adjacent wheels, each having at least three arcuate, radially outward, demountable, knife segments having a material hardness at least as hard as hardened steel, each wheel having an annular carrier having a side face, said side face having an axially outward extending annular support shoulder at a radius substantially less than a radius of the wheel, said side face further having an arcuate knife segment receiving surface radially outward and axially inward relative to said support shoulder, each arcuate knife segment having a first side joined to said arcuate segment receiving surface and having a planar second side in material shearing cooperative engagement with an arcuate segment of an adjacent wheel, each arcuate knife segment contacting said support shoulder, and having a radially outward periphery offset from exposed portions of the wheel periphery carrying the knife segment, and shim means for adjusting the spacing between each arcuate knife segment and an adjacent wheel, maintaining a material shearing thickness between said adjacent wheels, said shim means being disposed between said arcuate knife segment and said segment receiving surface of the annular carrier.

8. The apparatus of claim 7 wherein said shim means includes a number of spacers corresponding to the number of arcuate segments.

9. The apparatus of claim 7 wherein said side face of the annular carrier is a first side face, said annular carrier having a second side face having a segment receiving surface for mounting of said plurality of arcuate knife segments.

10. The apparatus of claim 7 wherein said arcuate knife segments each have an arcuate extent of at least 45°.

11. A method of assembling a rotary wheel comprising, cutting a number of arcuate knife segments from a planar steel slab, said arcuate segments defining an annulus of uniform thickness with inner and outer radii when laid end-to-end, hardening said arcuate segments, mounting said arcuate knife segments to the side of a wheel having a circumferential periphery between the inner and outer radii of said arcuate segments, the arcuate knife segments having planar faces extending axially outwardly with a sharp radially outward circumferential edge having been formed at the extremity of said planar faces, and inserting arcuate shims of specified thickness between the side of said wheel and said arcuate knife segments so that planar faces of said knife segments extend outwardly by a desired amount.

12. The method of claim 1 further defined by demounting said arcuate segments from said wheel, grinding each planar face to remove any deviations from a plane, and adjusting the positions of said arcuate segments relative to the wheel by said arcuate shims interposed between the wheel and said segments.

* * * * *